US008894394B2

(12) United States Patent
Sato et al.

(10) Patent No.: US 8,894,394 B2
(45) Date of Patent: Nov. 25, 2014

(54) SCROLL FLUID MACHINE HAVING A COMMUNICATION HOLE CONNECTING AN OIL SUPPLY PORT WITH A FIRST BEARING TO OPEN TOWARDS A FIXED SCROLL AND BEING ON A RADIALLY OUTER SIDE OF AN ORBITING END PLATE

(71) Applicant: ANEST IWATA Corporation, Yokohama (JP)

(72) Inventors: Toru Sato, Yokohama (JP); Junichi Asami, Yokohama (JP)

(73) Assignee: ANEST IWATA Corporation, Kanagawa (JP)

( * ) Notice: Subject to any disclaimer, the term of this patent is extended or adjusted under 35 U.S.C. 154(b) by 51 days.

(21) Appl. No.: 13/757,249

(22) Filed: Feb. 1, 2013

(65) Prior Publication Data

US 2013/0149179 A1 Jun. 13, 2013

Related U.S. Application Data

(63) Continuation of application No. PCT/JP2011/069089, filed on Aug. 24, 2011.

(30) Foreign Application Priority Data

Sep. 30, 2010 (JP) ..... 2010-222772

(51) Int. Cl.
*F03C 2/00* (2006.01)
*F04C 2/00* (2006.01)

(Continued)

(52) U.S. Cl.
CPC ..... *F01C 1/0207* (2013.01); *F04C 18/02* (2013.01); *F04C 2240/50* (2013.01);

(Continued)

(58) Field of Classification Search
USPC ..... 418/55.1–55.6, 57; 384/462, 474, 456; 464/102, 103; 184/6.16–6.18
See application file for complete search history.

(56) References Cited

U.S. PATENT DOCUMENTS

2003/0223898 A1* 12/2003 Fujioka et al. ..... 418/55.3
2005/0220649 A1 10/2005 Sato (Continued)

FOREIGN PATENT DOCUMENTS

JP 63050691 A * 3/1988 ..... F04C 18/02
JP 06213174 A * 8/1994 ..... F04C 18/02

(Continued)

OTHER PUBLICATIONS

English translation of International Search Report and Written Opinion issued in PCT/JP2011/069089, dated Apr. 9, 2013.

(Continued)

*Primary Examiner* — Theresa Trieu
(74) *Attorney, Agent, or Firm* — Lowe Hauptman & Ham, LLP

(57) ABSTRACT

A disc-like spacer arranged below a first roller bearing rotatably supporting a driven crankshaft that forms an anti-rotation system is formed with a plurality of notches in the circumferential direction. A spot face is provided to face the outer circumferential surface of the spacer, and communication holes and are drilled on the outer circumferential side of the spot face to extend in the axial direction of the scroll. Also formed is a communication hole communicating the communication hole with the first roller bearing via the notches. A grease nipple is mounted to the communication hole. To replenish grease, the fixed scroll is removed from the housing such that the orbiting scroll is exposed, and grease is injected from the grease nipple into the first roller bearing with a grease gun.

4 Claims, 3 Drawing Sheets

(51) Int. Cl.

| | |
|---|---|
| ***F04C 18/00*** | (2006.01) |
| ***F04C 18/02*** | (2006.01) |
| ***F04C 29/02*** | (2006.01) |
| ***F01C 1/02*** | (2006.01) |
| ***F01C 17/06*** | (2006.01) |
| ***F01C 21/04*** | (2006.01) |

(52) U.S. Cl.

CPC ..... *F04C 29/02* (2013.01); *F01C 1/0215* (2013.01); *F01C 17/063* (2013.01); *F01C 21/04* (2013.01); *F04C 2230/80* (2013.01); *F04C 2240/30* (2013.01)

USPC ..... 418/55.6; 418/55.1; 418/55.3; 384/462; 384/474; 184/6.18; 464/102

(56) References Cited

U.S. PATENT DOCUMENTS

| | | | | |
|---|---|---|---|---|
| 2007/0104602 | A1 | 5/2007 | Ishikawa et al. | |
| 2007/0172373 | A1* | 7/2007 | Ni | 418/55.3 |

FOREIGN PATENT DOCUMENTS

| | | | |
|---|---|---|---|
| JP | 7-002961 | Y2 | 1/1995 |
| JP | 20022277779 | A | 8/2002 |
| JP | 2005-282496 | A | 10/2005 |
| JP | 2007-132220 | A | 5/2007 |

OTHER PUBLICATIONS

International Search Report corresponding to PCT/JP2011/069089, dated Nov. 15, 2011.

* cited by examiner

SCROLL FLUID MACHINE HAVING A COMMUNICATION HOLE CONNECTING AN OIL SUPPLY PORT WITH A FIRST BEARING TO OPEN TOWARDS A FIXED SCROLL AND BEING ON A RADIALLY OUTER SIDE OF AN ORBITING END PLATE

RELATED APPLICATIONS

The present application is a bypass continuation of International Application Number PCT/JP2011/069089, filed Aug. 24, 2011, and claims priority from Japanese Application Number 2010-222772, filed Sep. 30, 2010, the disclosure of which is hereby incorporated by reference herein in its entirety.

TECHNICAL FIELD

The present invention relates to a grease supply unit for bearings that form an anti-rotation system with a crank mechanism in scroll fluid machines such as scroll compressors, scroll vacuum pumps, scroll expanders, and scroll blowers.

BACKGROUND ART

A conventional scroll fluid machine is formed by, for example, as shown in FIG. 1, a fixed scroll 10 having a first wrap 14 formed inside a recessed space s enclosed by a peripheral wall 12, and a movable orbiting scroll 20 having a second wrap 24 configured to interleave with the first wrap 14, and is configured to be capable of changing the volume of sealed pockets formed between the wraps 14 and 24 by revolving the orbiting scroll 20 around the fixed scroll 10 without rotating the orbiting scroll 20.

The orbiting scroll 20 is revolved by a revolving mechanism that includes a main drive crankshaft 42 coupled to the orbiting scroll 20 via an integral eccentric shaft 44 made eccentric to the orbiting scroll 20 by an amount corresponding to the orbiting radius, this main drive crankshaft 42 being rotatably supported along a center axis of a housing 40 and rotated, to impart a revolving motion of the orbiting scroll 20. Anti-rotation systems 50 each having a driven crankshaft 52 that undergoes an eccentric rotation with an eccentric amount corresponding to that of the main drive crankshaft 42 are provided at a certain distance in the radial direction from the center axis of the main drive crankshaft 42, symmetrically in the circumferential direction.

This anti-rotation system 50 prevents rotation of the orbiting scroll 20 while allowing it to revolve as the main drive crankshaft 42 rotates. The driven crankshaft 52 is rotatably supported by a first roller bearing 54 secured in the housing 40, and an eccentric shaft 52*a* integral with the driven crankshaft 52 is rotatably supported by a second roller bearing 56 that is supported by the orbiting scroll 20.

In scroll fluid machines, particularly in compressors, to achieve clean compressed gas, a spiral self-lubricating seal member 30 is fitted in a groove recessed in the end face of the second wrap 24 of the orbiting scroll 20 contacting the fixed scroll 10, and in the end face of the first wrap 14 of the fixed scroll 10 contacting the end plate 22 of the orbiting scroll 20. Thus, while the wraps are maintained oil-free, the inside of the recessed space s is kept tightly sealed from the outside.

In oil-free scroll fluid machines, the orbiting scroll 20 is adjusted to achieve precise parallelism and a clearance relative to the fixed scroll 10 to revolve with adequate interleaving precision. This is for preventing various problems such as leakage from the recessed space s, noise caused by contact between a wrap and the sliding surface of the counterpart, abnormal abrasion, increase in power due to a wrap contacting on one side, and durability loss of bearings, etc. Oil-free scroll fluid machines commonly rely on sealed grease as they do not have means of lubricating the bearings of the main drive crankshaft 42 and driven crankshafts 52. With this sealed grease, however, the grease-sealed part need to be replenished with grease periodically.

Patent Document 1 (Japanese Examined Utility Model Application Publication No. H7-2961) discloses means of replenishing grease for a bearing 46 rotatably supporting an eccentric shaft 44 of the main drive crankshaft 42. This grease replenishing means has an oil supply passage 60 drilled from an outer circumferential surface of a balance weight 48 attached to the eccentric shaft 44 and opens to a shaft end of the eccentric shaft 44, as shown in FIG. 1. The opening of the oil supply passage 60 at the shaft end of the eccentric shaft is brought opposite a bearing plate 26 attached to the orbiting scroll 20 to communicate with the bearing 46 through a gap c formed between the eccentric shaft end and the bearing plate 26.

To replenish grease, the opening of the oil supply passage 60 at the outer circumferential surface of the balance weight is brought opposite a grease gun port formed in the housing 40, and grease is replenished through the oil supply passage 60 from a grease gun inserted into the grease gun port.

Patent Document 2 (Japanese Patent Application Laid-open No. 2002-227779) discloses two means of replenishing grease for a first roller bearing 54 and a second roller bearing 56 that form an anti-rotation system 50. This replenishing means will be described with reference to FIG. 1. Referring to FIG. 1, the first replenishing means is an oil supply passage drilled in the driven crankshaft 52 along the axial direction to open to the inside of a bearing holder 70 at one end and to a slit gap c formed between the second roller bearing 56 and the bearing plate 26 at the other end. A grease nipple is mounted to the opening at the bearing holder 70 to supply grease to the first roller bearing 54 and the second roller bearing 56 through the oil supply passage.

The second replenishing means disclosed in Patent Document 2 is a second oil supply passage, in addition to the oil supply passage described above, drilled in the housing 40 that supports the first roller bearing 54 in a direction orthogonal to the scroll axis from a radially outer side of the first roller bearing 54. The second oil supply passage passes through the first roller bearing 54 and communicates with the previously mentioned oil supply passage. A grease nipple is mounted to the second oil supply passage for injecting grease.

The grease replenishing means disclosed in Patent Document 3 (Japanese Patent Application Laid-open No. 2005-282496), which will be explained with reference to FIG. 1, is means of injecting grease into the bearing 46 from the fixed scroll side, via a through hole formed in a central portion of the end plate 22 of the orbiting scroll 20. Also disclosed is means of injecting grease into the second roller bearing 56 via a through hole formed in the bearing plate 26 that supports the second roller bearing 56 at a position outside the orbiting scroll 20.

Patent Document 1: Japanese Examined Utility Model Application Publication No. H7-2961

Patent Document 2: Japanese Patent Application Laid-open No. 2002-227779

Patent Document 3: Japanese Patent Application Laid-open No. 2005-282496

Patent Document 2 discloses means of replenishing grease to the first roller bearing 54. However, with the first replenishing means disclosed in Patent Document 2, the bearing holder 70 needs to be removed, and a grease nipple needs to be mounted to the opening at the bearing holder 70, to replenish grease. Since a pulley 100, a cooling fan 104, and a cooling fan cover 106, etc. are attached at the other end of the main drive crankshaft 42 as shown in FIG. 1, these components need to be removed to set a grease gun on the pulley 100 side.

The second replenishing means disclosed in Patent Document 2 requires extra space on the radially outer side of the housing 40 for installing the grease gun. The second oil supply passage is drilled in a direction orthogonal to the axial direction of the scroll, and oriented at right angle with the oil supply passage drilled in the driven crankshaft 52. Therefore, these oil supply passages cannot be formed at the same time with a cutting machine, and an extra number of process steps is required.

When replacing the self-lubricating seal members 30 mentioned above in scroll fluid machines, it is necessary to remove the fixed scroll 10 from the housing 40. It is desirable if, at this time, grease can also be supplied to the first roller bearing 54.

DISCLOSURE OF THE INVENTION

In view of these problems in the conventional techniques, an object of the present invention is to allow simple grease supply to bearings secured to a housing, in an anti-rotation system of an oil-free or oil-filled scroll fluid machine, without the need of extensive disassembling or processing of the scroll main body.

To solve the above problems, the scroll fluid machine according to the present invention is an oil-free scroll fluid machine including: a revolving mechanism that revolves an orbiting scroll with a drive crankshaft attached eccentrically to the orbiting scroll; and an anti-rotation system formed by a crank mechanism including a driven crankshaft rotatably supported by a first bearing that is supported in a housing, and an eccentric shaft integral with the driven crankshaft and rotatably supported by a second bearing that is supported by the orbiting scroll. The scroll fluid machine is provided with an oil supply port provided in a casing of the first bearing or in the housing that supports the casing to open toward a fixed scroll at a position on a radially outer side of an end plate of the orbiting scroll, and a communication hole that communicates the oil supply port with the first bearing.

According to the present invention, with the oil supply port and the communication hole, it is only the fixed scroll that needs to be removed from the housing to expose the orbiting scroll, for injecting grease into the first bearing. Therefore, no extensive disassembling of the scroll machine is necessary, and grease replenishment work is made easy. Accordingly, grease can be replenished to the first bearing at the same time with replacing self-lubricating seal members 30 without any extra disassembling work.

Since the oil supply port opens toward the fixed scroll, a grease gun can be attached to the oil supply port in an orientation along the axial direction of the scroll, so that no extra space is required on the radially outer side of the housing during replenishment of grease. Furthermore, as the oil supply port is located close to the first bearing, the machining process to form the communication hole is made easy.

In the present invention, the communication hole may be partly formed by a spot face formed at a base of the casing of the first bearing or at a base of the housing that supports the casing, and a notch cut out in a disc-like spacer enclosing a coupling portion between the driven crankshaft and the eccentric shaft for communicating the spot face with the first bearing.

The spot face is formed for the purpose of increasing the flexibility of the casing of the first bearing or the housing that supports the casing when press-fitting the first bearing into the casing to facilitate the press-fitting. Such spot face that is already provided is used as part of the communication hole, so that the communication hole is formed easily.

Using the disc-like spacer makes the formation of the communication hole easy. With a simple machining process to form a notch in the spacer, the spot face can be communicated with the first bearing.

In the present invention, in addition to the oil supply port and the communication holes, a through hole may be drilled in a bearing plate that supports the second bearing at a position outside the end plate of the orbiting scroll, to open toward the fixed scroll and to communicate with the second bearing.

This, with only the fixed scroll being removed from the casing, will allow grease supply to the first bearing and the second bearing at the same time.

In the present invention, grease nipples may be mounted to the oil supply port communicating with the first bearing and to the second oil supply port communicating with the second bearing respectively. This will facilitate the oil supply with a grease gun, and prevent grease leakage from these oil supply ports and entrance of dirt or dust into the oil supply ports.

According to the device of the present invention, the scroll fluid machine includes: a revolving mechanism that revolves an orbiting scroll with a drive crankshaft attached eccentrically to the orbiting scroll; and an anti-rotation system formed by a crank mechanism including a driven crankshaft rotatably supported by a first bearing that is supported in a housing, and an eccentric shaft integral with the driven crankshaft and rotatably supported by a second bearing that is supported by the orbiting scroll, wherein an oil supply port is provided in a casing of the first bearing or in the housing supporting the casing to open toward a fixed scroll at a position on a radially outer side of an end plate of the orbiting scroll, and a communication hole is provided to communicate the oil supply port with the first bearing, whereby, with only the fixed scroll being removed from the scroll main body, grease can be injected into the first bearing. Therefore, no extensive disassembling of the scroll machine is necessary, and since the oil supply port opens toward the fixed scroll, no extra space is required on the radially outer side of the housing during supply of oil, so that grease can be supplied easily to the first bearing. Furthermore, as the oil supply port is located close to the first bearing, the machining process to form the communication hole is made easy.

BEST MODE FOR CARRYING OUT THE INVENTION

Hereinafter, a preferred embodiment of the present invention will be illustratively described in detail with reference to the drawings. It should be noted that, unless otherwise particularly specified, the sizes, materials, shapes, and relative arrangement or the like of constituent components described in these embodiments are not intended to limit the scope of this invention.

Figure 1:
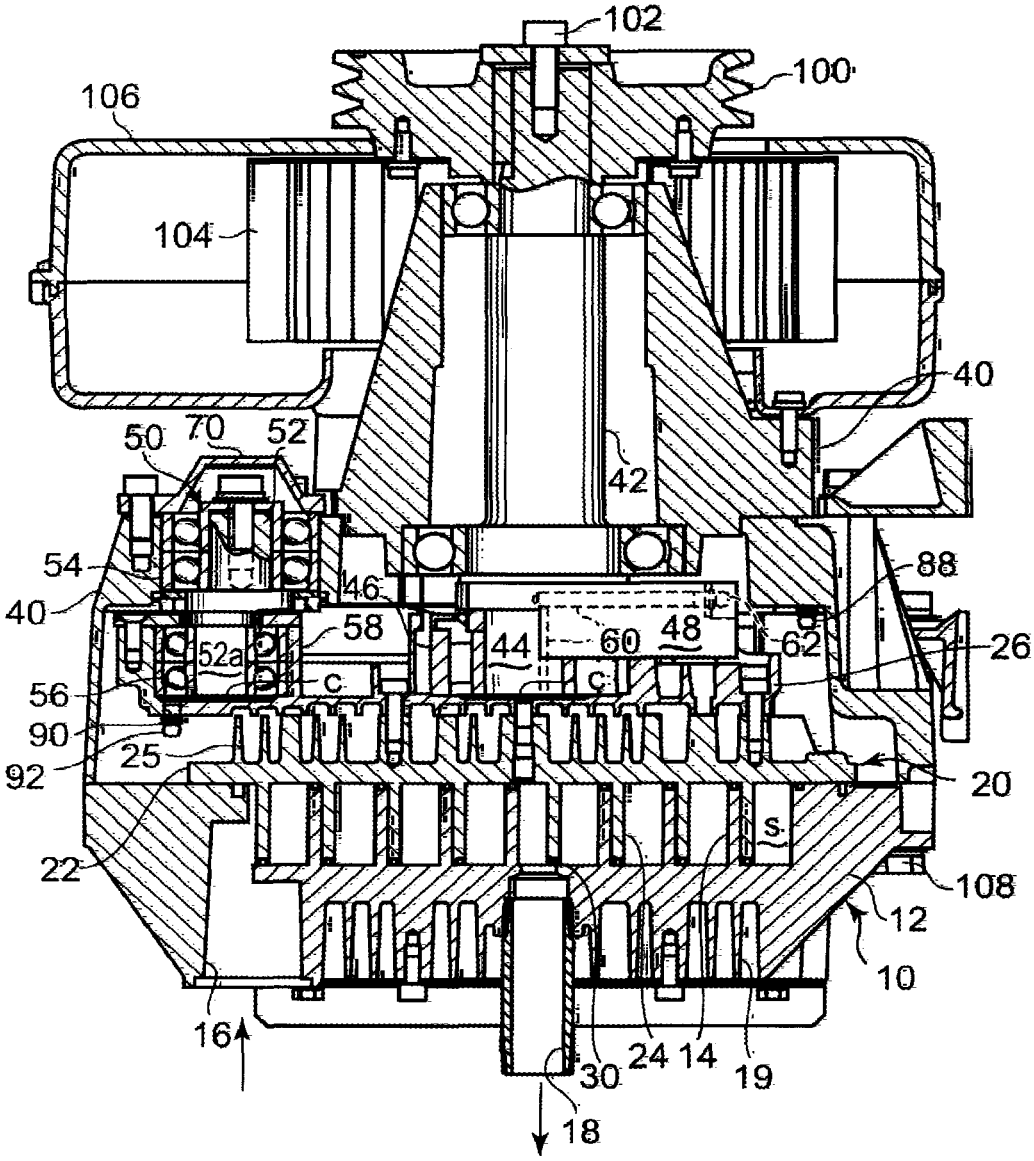
Fig. 1 (Prior Art)
FIG. 1 is an overall cross-sectional view of an oil-free scroll compressor to which the present invention is applied.

One embodiment of the device of the present invention will be described with reference to FIG. 1 to FIG. 4. FIG. 1 shows an oil-free scroll compressor to which the present invention is applied. As mentioned before, the compressor is made up of a fixed scroll 10, an orbiting scroll 20, and a housing 40 that supports these at predetermined positions fixedly or revolvably. The general structure of these components will be briefly explained.

The fixed scroll 10 is fixedly attached to an end face of the housing 40, and has a first spiral wrap 14 formed upright inside a recessed space s enclosed by a peripheral wall 12 that has an intake port 16. A discharge port 18 for discharging compressed fluid is provided substantially at the center of the first wrap 14.

The orbiting scroll 20 is accommodated in a recessed space inside the housing 40, and includes an end plate 22 in contact with a flat surface of the peripheral wall 12, and a second wrap 24 standing upright on the end plate 22 and having substantially the same spiral shape as that of the first wrap 14. The first wrap 14 and the second wrap 24 are offset by 180° and interleaved with each other. Cooling fins 19 and 25 are formed on the backsides of the fixed scroll 10 and the orbiting scroll 20, respectively, so that the inside of the scrolls can be cooled by air.

The first wrap 14 and the second wrap 24 each have a recessed groove in their end faces contacting the end plates of each other's scrolls, and a spiral self-lubricating seal member 30 fitted in the groove, so that the wraps can slide on each other without lubrication while maintaining air tightness of the recessed space s.

The housing 40 supports a main drive crankshaft 42 rotatably along a center axis thereof, with a pulley 100 coupled to one end of the crankshaft, and also supports first roller bearings 54 that form an anti-rotation system 50 at every 120° (three locations) around the main drive crankshaft 42.

An eccentric shaft 44 is integrally formed at the distal end of the main drive crankshaft 42 and rotatably supported by a bearing 46, which bearing 46 is coupled to a bearing plate 26 that is integral with the orbiting scroll 20.

Driven crankshafts 52 are rotatably supported by the first roller bearings 54 that are held in the housing 40. Eccentric shafts 52*a* integral with the driven crankshafts 52 are rotatably supported by second roller bearings 56, which second roller bearings 56 are encased in bearing cases 58 that are integral with the bearing plate 26.

Thus, when the pulley 100 is rotated by a V-belt that is not shown, the main drive crankshaft 42 coupled to the pulley 100 with a bolt 102 rotates. The eccentric shaft 44 revolves as the main drive crankshaft 42 rotates, which imparts an eccentric rotation of the three driven crankshafts 52 with an eccentricity corresponding to that of the main drive crankshaft 42. This allows the orbiting scroll 20 to revolve in an orbit of a constant radius while it is prevented from rotating. As such a configuration is already known, it will not be described in detail.

Figure 2:
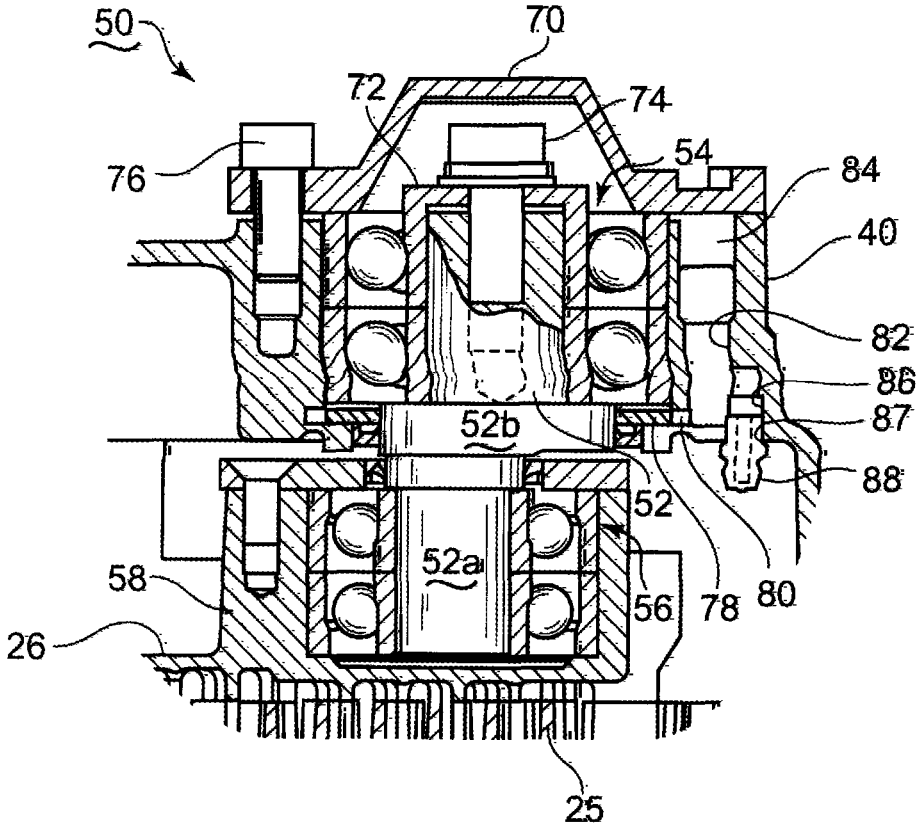
FIG. 2 is an enlarged partial cross-sectional view of the scroll compressor.

FIG. 2 illustrates the configuration of the anti-rotation system 50. In the drawing, an inner race assembly 72 of the first roller bearing 54 is coupled to the driven crankshaft 52 with a bolt 74. A bearing holder 70 is mounted to the end face of the first roller bearing 54 with a bolt 76. The second roller bearing 56 rotatably supporting the eccentric shaft 52*a* that is integral with the driven crankshaft 52 is encased in a bearing case 58 that is integrally formed with the bearing plate 26.

Figure 3:
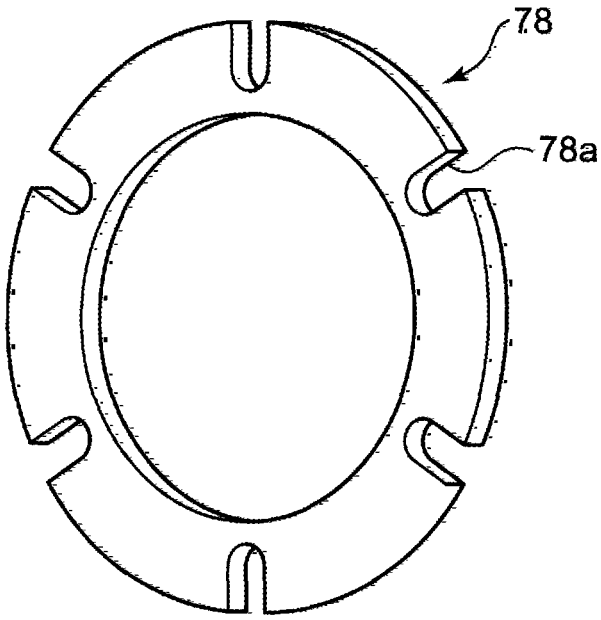
FIG. 3 is a perspective view of one component of the scroll compressor.

A spacer 78 is disposed such as to surround a connecting shaft 52*b* in between the driven crankshaft 52 and the eccentric shaft 52*a*. As shown in FIG. 3, the spacer 78 is disc-shaped and has six circumferentially equally spaced notches 78*a* cut out in an outer circumferential surface thereof. A ring-like spot face 80 having a rectangular cross section is formed in the housing 40 at a position on the outer circumferential side of the spacer 78. This spot face 80 is formed for the purpose of increasing the flexibility of the housing 40 when press-fitting the first roller bearing 54 into the housing 40.

A communication hole 82 is drilled on the outer circumferential side of the spot face 80 in the axial direction of the scroll, and the opening of this communication hole 82 is hermetically closed by a sealing plug 84. A communication hole 86 is drilled on the outer circumferential side of the communication hole 82 in the axial direction of the scroll, to communicate with the communication hole 82. An oil supply port 87 of the communication hole 86 opens toward the fixed scroll 10 in the axial direction of the scroll main body. A grease nipple 88 is attached to the oil supply port 87.

Referring to FIG. 1, a through hole 90 is drilled in the bearing plate 26 at a position corresponding to the first roller bearing 54 in the axial direction of the scroll on the radially outer side of the end plate 22. The opening of this through hole 90 opens toward the fixed scroll 10 in the axial direction of the scroll main body, with a grease nipple 92 attached to the opening.

Figure 4:
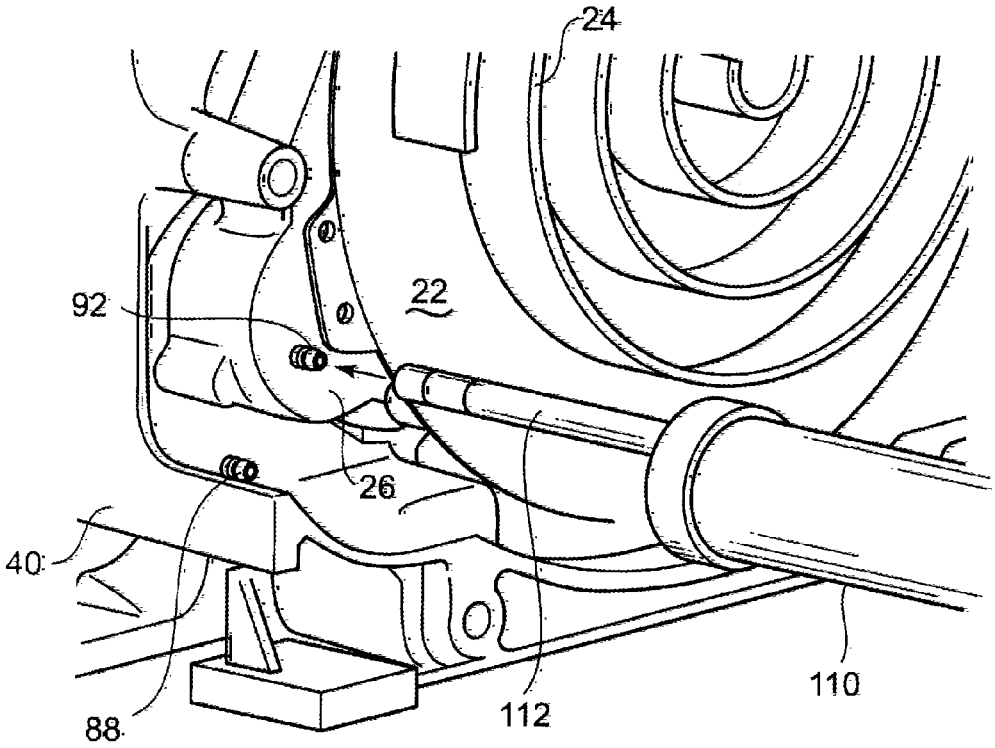
FIG. 4 is a perspective view of the scroll compressor when grease is replenished.

FIG. 4 shows a state where the orbiting scroll 20 is exposed after the fixed scroll 10 has been removed. FIG. 4 shows the locations of the grease nipples 88 and 92. The communication hole 86 and the grease nipple 88, and the through hole 90 and the grease nipple 92, are on the outer circumferential side of the end plate 22, and provided at every 120° (three locations) around the main drive crankshaft 42.

A pulley 100 is mounted at the other end of the main drive crankshaft 42 with a bolt 102. On the pulley 100 side are a cooling fan 104 that is connected to and rotates with the pulley 100, and a cooling fan cover 106 that covers the cooling fan 104, fixedly attached to the housing 40.

To replenish grease for the first roller bearings 54 and the second roller bearings 56 in this configuration, the bolt 108 that secures the fixed scroll 10 to the housing 40 is unfastened to remove the fixed scroll 10 from the housing 40. In this state, the end plate 22 and the second wrap 24 of the orbiting scroll 20 are exposed to the outside, and so are the grease nipples 88 and 92. A grease gun 110 is oriented along the axial direction of the scroll relative to the grease nipples 88 and 92, as shown in FIG. 4, and the grease gun tip 112 is attached to these grease nipples to inject grease.

The grease injected from the grease nipple 88 into the communication hole 86 travels through the communication hole 82, the spot face 80, and the notches 78*a* of the spacer 78 and reaches the first roller bearing 54. The grease injected into the through hole 90 through the grease nipple 92 is supplied to the second roller bearing 56 from the through hole 90.

With this embodiment, only the fixed scroll 10 needs to be removed from the housing 40 to replenish grease to the first roller bearings 54 and the second roller bearings 56. Therefore, the disassembling work for grease replenishment is made simple. Since it is only necessary to remove the fixed scroll 10, grease can be replenished for the first roller bearings 54 and the second roller bearings 56 at the same time when the self-lubricating seal members 30 are replaced.

In addition, since the grease nipples 88 and 92 are attached along the axial direction of the scroll, they do not necessitate extra space on the radially outer side of the housing 40 when grease is replenished. Therefore, grease can be replenished in a confined space. Also, since the grease nipples 88 and 92 are located on the outer circumferential side of the end plate 22, the grease gun 110 can be readily attached to these grease nipples.

Part of the hole for communicating the communication hole 82 with the first roller bearing 54 is formed by utilizing the spot face 80 that is already provided, and the notches 78*a* formed in the spacer 78, so that the number of communication holes to be machine-processed is reduced. Furthermore, since the communication holes 82 and 86 are formed along the axial direction of the scroll, they can be simultaneously machined on a single axis when forming these communication holes with a cutting machine, whereby the number of process steps is reduced.

The grease nipples 88 and 92 already mounted to the communication hole 86 and the through hole 90 respectively facilitate grease replenishment with the grease gun 110, as well as prevent leakage of grease from, or entrance of dust into, the communication hole 86 and the through hole 90.

Referring to FIG. 1, a fan-shaped balance weight 48 is attached to the eccentric shaft 44 of the main drive crankshaft 42 to correct the center of gravity that is offset in accordance with the eccentric distance of the eccentric shaft 44. An oil supply passage 60 is formed in the balance weight 48 and the eccentric shaft 44 to open to the outer circumferential surface of the balance weight 48 and to a slit gap c between the eccentric shaft 44 and the bearing plate 26. The slit gap c extends longer than the outside diameter of the inner race of the bearing 46.

A grease nipple 62 is mounted to the opening on the balance weight side of the oil supply passage 60. The eccentric shaft 44 is rotated as required to bring the grease nipple 62 opposite a grease gun port (not shown) opened in the housing 40. In this way, grease can be replenished to the bearing 46 with a grease gun inserted from the grease gun port through the oil supply passage 60 and the slit gap c. Such means of replenishing grease for the bearing 46 is disclosed in Patent Document 1, as mentioned in the foregoing.

While this embodiment is directed to oil-free scroll compressors, the present invention can also be applied to oil-filled scroll fluid machines.

INDUSTRIAL APPLICABILITY

With the present invention, grease replenishment to bearings that form an anti-rotation system of a scroll fluid machine can be performed simply without extensive disassembling of the machine.

The invention claimed is:

1. A scroll fluid machine, comprising: a revolving mechanism that revolves an orbiting scroll with a drive crankshaft attached eccentrically to the orbiting scroll; and an anti-rotation system formed by a crank mechanism including a driven crankshaft rotatably supported by a first bearing that is supported in a housing, and an eccentric shaft integral with the driven crankshaft and rotatably supported by a second bearing that is supported by the orbiting scroll, wherein an oil supply port is provided in a casing of the first bearing or in the housing supporting the casing to open toward a fixed scroll at a position on a radially outer side of an end plate of the orbiting scroll, and a communication hole that communicates the oil supply port with the first bearing is provided.

2. The scroll fluid machine according to claim 1, wherein the communication hole is partly formed by a spot face formed at a base of the casing of the first bearing or at a base of the housing supporting the casing, and a notch cut out in a disc-like spacer enclosing a connecting portion between the driven crankshaft and the eccentric shaft for communicating the spot face with the first bearing.

3. The scroll fluid machine according to claim 1, wherein a through hole is drilled in a bearing plate that supports the second bearing at a position outside the end plate of the orbiting scroll, to open toward the fixed scroll and to communicate with the second bearing.

4. The scroll fluid machine according to claim 1, wherein grease nipples are mounted to an opening of the oil supply port and to an opening of the through hole respectively.

* * * * *